United States Patent [19]

Föhl

[11] Patent Number: 4,543,694

[45] Date of Patent: Oct. 1, 1985

[54] LOCK FOR SAFETY BELTS

[75] Inventor: Artur Föhl, Schorndorf, Fed. Rep. of Germany

[73] Assignee: Repa Feinstanzwerk GmbH, Alfdorf, Fed. Rep. of Germany

[21] Appl. No.: 554,773

[22] Filed: Nov. 23, 1983

[30] Foreign Application Priority Data

Nov. 25, 1982 [DE] Fed. Rep. of Germany ..... 3243655

[51] Int. Cl.[4] ..... A44B 19/00

[52] U.S. Cl. ..... 24/656; 24/639; 24/642

[58] Field of Search ..... 24/656, 657, 658, 639, 24/642, 643, 171, 194

[56] References Cited

U.S. PATENT DOCUMENTS

| | | | |
|---|---|---|---|
| 941,096 | 11/1909 | Wilkenfeld et al. | 24/656 |
| 2,556,117 | 6/1951 | Smith et al. | 24/656 |
| 2,635,317 | 4/1953 | Harley | 24/639 |
| 2,927,814 | 3/1960 | Reitzel | 24/656 |
| 3,332,117 | 7/1967 | McCarthy | 24/565 |
| 4,310,953 | 1/1982 | Nanasi | 24/656 |
| 4,374,449 | 2/1983 | Stephenson et al. | 24/656 |

FOREIGN PATENT DOCUMENTS

| | | | |
|---|---|---|---|
| 1328405 | 4/1963 | France | 24/656 |
| 1409848 | 7/1965 | France | 24/656 |
| 444552 | 2/1968 | Switzerland | 24/657 |
| 1156406 | 6/1969 | United Kingdom | 24/642 |

*Primary Examiner*—Victor N. Sakran

*Attorney, Agent, or Firm*—Yount & Tarolli

[57] ABSTRACT

Lock for safety belts with a belt lock and an insertion tab which can be detented at a latch, which latch can be moved transversely to the insertion direction when the insertion tab is inserted, preferably by the latter itself into the open position against a spring force. The latch can be brought out of detent engagement with the insertion tab by a manual pressure member. A run-up bevel is provided at the abutting edges of the latch and the insertion tab. The latch can be moved into the unlatched position only in part by the pressure member and ultimately by the insertion tab itself. The run-up bevel is at the abutting edge of the insertion tab cooperating with the latch with the height of the contact area for the latch smaller than the thickness of the insertion tab.

3 Claims, 7 Drawing Figures

LOCK FOR SAFETY BELTS

BACKGROUND OF THE INVENTION

1. Field of the Invention

The invention relates to a lock for safety belts with a belt lock and an insertion tab which can be detented at a latch, which latch can be moved transversely to the insertion direction when the insertion tab is inserted, and which latch can be brought out of detent engagement with the insertion tab by a manual pressure member.

2. Description of the Prior Art

In a known lock for safety belts with a belt latch and an insertion tab fastened to the free end on the safety belt band, the latch which can be detented with the insertion tab is arranged movably in the lock housing as a run-up bevel facing the latching edge of the insertion tab. The latch is moved against a spring force by a manually operable pressure organ, for instance a push button, from the locked position. The moving stroke of the pressure organ or pressure member can be very small because the latching edge of the insertion tab engages the inclined run-up bevel of the latch after a relatively small stroke. Thus, in opening the lock, after initial movement of the latch by the pressure organ, the latch is pushed completely into the opening position, usually, by the spring force of an injection element. The working stroke of the pressure organ, for instance, of the push button therefore need be only part of the total opening stroke of the latch which among other things has the advantage that due to this small actuating stroke, the overall height of the belt lock can be relatively small. However, in the mechanical design of the latch which is provided with the run-up bevel or bevels, certain problems arise since this latch, designed as a relatively small part, must be very strong and must be inserted, in the locked position, as a rule into openings of both metallic plates which form the insertion guide for the insertion tab. Under these circumstances, the run-up bevels mean a weakening of the latch cross section.

SUMMARY OF THE INVENTION

An object of the invention is to provide a lock for safety belts of the mentioned type in which a reduction of the actuating stroke of the pressure organ is obtained and thereby a reduction of the overall height of the lock housing, with a simple design of the latch which is determined only by strength considerations.

With the foregoing and other objects in view, there is provided in accordance with the invention a lock for a safety belt comprising a belt lock having a lock housing with an insertion path and an insertion tab with a detent for insertion in the insertion path of the lock housing, a latch in the housing, movable transversely to the insertion path, said latch upon insertion of the insertion tab in the insertion path moved transversely to an open position in which the insertion tab is not blocked to permit detent engagement of the latch with the insertion tab with an edge of the detent of the insertion tab smaller than the thickness of the insertion tab abutting a side of the latch, a manual pressure member movable to move the latch only a part of the distance necessary for shifting the latch from the engaged position to a disengaged position, a run-up bevel at the abutting edge of the detent of the insertion tab moves the latch the remaining necessary distance to a disengaged position in which the insertion tab may be withdrawn from the insertion path of the belt lock.

Other features which are considered as characteristic for the invention are set forth in the appended claims.

Although the invention is illustrated and described herein as embodied in a lock for safety belts, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
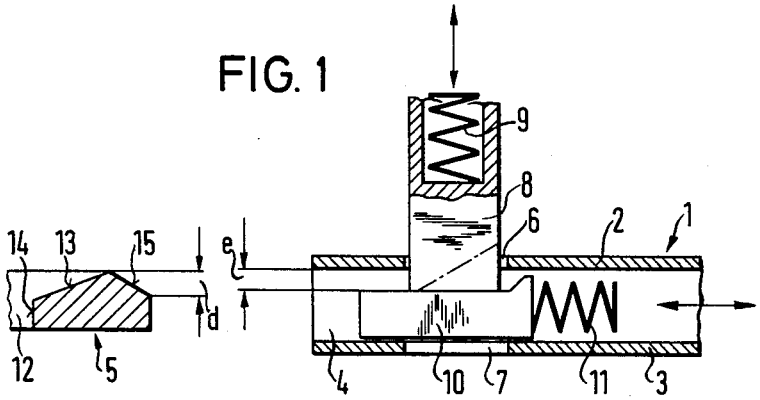
FIGS. 1 and 2 show the lock for safety belts according to the invention in a schematic cross-sectional view and in two different actuation positions.

According to the invention, the abutting edges of the insertion tab cooperating with the latch are provided with run-up bevels, due to which the height of the contact surface for the latch is smaller than the thickness of the insertion tab.

By relocating the run-up bevels to the insertion tab, a very simple mechanical design without problems is obtained for the latch in the belt lock. It can be made, for instance as a simple stamped part, the cross section of which can be kept relatively small since the run-up bevel at this latch can be completely eliminated. The design of the insertion tab with the run-up bevel raises no production problems and can be done in a simple press operation. Such a design is possible with any type of insertion tab, for instance, with an insertion tab with the internal latching, such as a latching opening at the end of the insertion tab or, with insertion tabs having external latching, for instance with L- or T-shaped design of the end of the insertion tab.

In a preferred embodiment two run-up bevels inclined relative to each other in V-fashion adjoin the abutting edge of the insertion tab. Through this more or less symmetrical arrangement of the run-up bevels, the insertion tab can be inserted into the belt lock reversed, i.e. rotated 180°.

To ensure that the insertion tab can be inserted into the belt lock only in a single predetermined position, protection against incorrect insertion is provided according to a further embodiment of the invention, by a further inclined run-up bevel at the end face of the insertion tab. The latch extends, in the open position, into the insertion track within the lock housing by a dimension which is smaller than the projected depth dimension of the above-mentioned run-up bevel. In this manner, the front edge of the insertion tab which is not provided with the further run-up bevel hits this latch if it is inserted incorrectly which makes complete insertion impossible. If inserted correctly, the latch runs up onto the above-mentioned run-up bevel and is pushed completely into the opening position.

The invention will be explained in the following with the aid of embodiment examples shown in the drawings.

Figure 2:
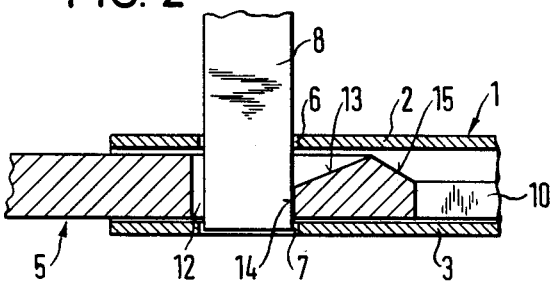
Figure 3:
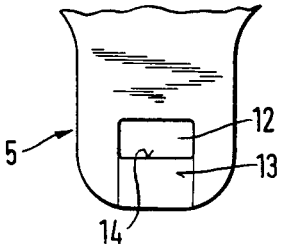
FIGS. 3 and 4 show two different embodiments of an insertion tab according to the invention.
Figure 7:
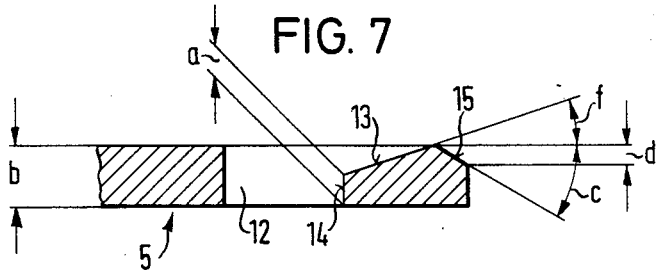

In the embodiment example according to FIGS. 1 and 2, a metallic U-shaped lock frame with two mutually parallel plates 2 and 3 is generally designated with 1. These plates define an insertion track or path 4 for an insertion tab 5 which is fastened to the free end of the flexible safety belt band. The two plates 2 and 3 have openings 6 and 7 which are aligned with each other and in which a latch 8 with, for instance, a rectangular cross section is guided movably in the arrow direction. The latch is pushed downward into the locked position by spring 9 shown in FIG. 1. This locked position is shown in FIG. 2. In the rest position, i.e. with the insertion tab 5 not locked, the free end of the latch 8 is braced against an injector element 10, which is guided in the insertion track 4 and is pushed by a spring 11 in the direction of the insertion opening of the lock frame 1. As shown by FIGS. 1, 2, 3 and 7, the insertion tab 5 has an insertion opening 12, the inside width of which is slightly larger than the cross section of the latch 8. The insertion opening 12 is followed toward the insertion side by a slightly inclined run-up bevel 13. At the abutting edge 14, a contact area for the latch 8 with the height a is shown in FIG. 7. The insertion front side of the insertion tab 5 is followed at the above-mentioned run-up bevel 13, by a further run-up bevel 15 which is inclined at an angle c. The projection depth dimensions d of this run-up bevel 15 is slightly larger than the dimension e, which is the distance the latch 8 extends into the insertion track 4 in the non-operated position. The angle of inclination of the run-up bevel 13 is designated with f. Although not specifically shown the lock frame 1 is surrounded in the usual manner by a lock housing formed, for instance, by two shell-like lock halves. Also not shown is a conventionally used manually operable pressure organ or member which is operationally conncted to the latch 8 and is designed, for instance, in the form of a push button. The latch 8 can be moved from the locked position shown in FIG. 2, at least partially into the open position, in the direction of the arrow as shown in FIG. 1 if this pressure organ is operated. By inserting the insertion tab 5 into the insertion track 4 of the lock frame 1, the ejector element 10 is pushed to the right (FIG. 1) against the force of the spring 11, so far that the insertion opening 12 is at the height of the latch 8. With the insertion of the insertion tab 5, the boundary edge of the latch 8 on the front side runs up on the run-up bevel 15 of the insertion tab 5 and is pushed by the insertion tab 5 itself all the way from outside the insertion track 4, so that the insertion tab 5 can be inserted completely into the insertion track 4. If the position of the insertion tab 5 is incorrect, i.e. the run-up bevel 15 is below that shown in FIG. 1, the insertion tab 5 fits against the latch 8 and cannot be inserted completely. After the insertion tab 5 is correctly inserted, the latch 8 is pushed by the spring 9 into the locked position according to FIG. 2. In this position the abutment edge 14 of the insertion tab 5 strikes the latch 8 immediately. To unlock the insertion tab 5, it is only necessary to lift the latch 8 by operating the pressure organ by the dimension a according to FIG. 7 which is considerably smaller than the thickness b of the insertion tab 5. Thereupon, the latch 8 is moved automatically by the insertion tab 5, i.e. by the spring force of the ejector element 10, into the open position according to FIG. 1, so that the insertion tab 5 can be pulled out of the belt lock completely.

Figure 5:
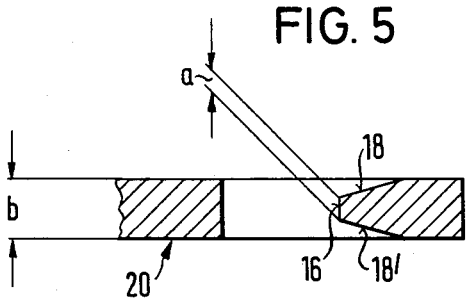
FIGS. 5–7 show cross-sectional views of three different insertion tab profiles.
Figure 6:
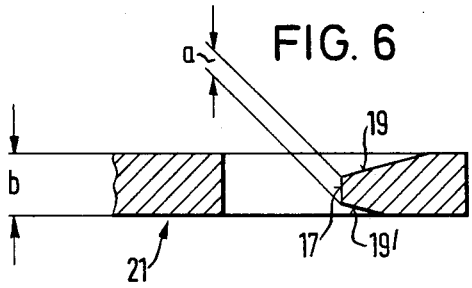

In the embodiment example according to FIGS. 5 and 6, the abutting edges 16 and 17, respectively, with the dimensions a are followed symmetrically or slightly asymmetrically by two each run-up bevels 18, 18' and 19, 19' which are related to each other in V-fashion. In these embodiments, the insertion tab 20 or 21 can be inserted into the lock frame 1 alternatingly rotated 180°. Also in these embodiment examples, the dimension a is substantially smaller than the material thickness b of the insertion tab.

Figure 4:
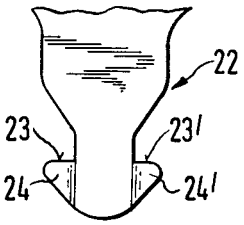

In FIG. 4, an insertion tab 22 of different design is indicated schematically. This is an insertion tab with external latching, for which purpose the insertion tab is T-shaped at the insertion end with external abutting edges 23 and 23' as well as with run-up bevels 24 and 24' adjoining them.

The foregoing is a description corresponding, in substance, to German application P 32 43 655.6, dated Nov. 25, 1982, international priority of which is being claimed for the instant application, and which is hereby made part of this application. Any material discrepancies between the foregoing specification and the specification of the aforementioned corresponding German application are to be resolved in favor of the latter.

I claim:

1. Lock for a safety belt comprising:

a lock housing with an insertion path;

an insertion tab for insertion into the insertion path of the lock housing;

a latch in the housing, which is movable transversely to the insertion path;

an ejector element movable along the insertion path to eject said insertion tab;

and a manually pressure member movable to initiate shifting of said latch from a closed position engaging said insertion tab into an open position for disengagement of said latch from said insertion tab;

said latch being spring biased into its closed position;

said ejection element being spring biased into an ejection position corresponding to the ejection of said insertion tab;

said insertion tab having a front edge for abutment against the ejection element, a run-up bevel for cooperation with said latch when said insertion tab is ejected from said insertion path, and an abutment edge adjacent to said run-up bevel for cooperation with said latch when said latch is in its closed position to block said insertion tab in said lock, housing;

said latch being held in its open position by abutment against said ejection element after said ejection element has ejected said insertion tab;

said ejection element, upon insertion of said insertion tab along said insertion path, being pushed by said front edge of said insertion tab into a position disengaging said latch to permit said latch to engage said abutment edge of said insertion tab when it is fully inserted into said lock housing;

and said manual pressure member, upon manual actuation thereof, pushing said latch sufficiently to disengage said abutment edge from said latch, said latch being further urged into its open position by cooperation with said run-up bevel by the action of said ejection element pushing said insertion tab out of said insertion path.

2. Lock according to claim 1, wherein said insertion tab has a further run-up bevel adjacent its front edge for cooperation with said latch when said insertion tab is inserted along said insertion path to urge said latch out of said insertion path and permit further insertion of said insertion tab.

3. Lock according to claim 1, wherein two run-up bevels inclined relative to each other in V-fashion are provided adjacent said abutment edge.

* * * * *